US007334369B2

(12) United States Patent
Carson

(10) Patent No.: US 7,334,369 B2
(45) Date of Patent: Feb. 26, 2008

(54) SYSTEM FOR DISLODGING AND REMOVING DEBRIS IN GUTTERS

(76) Inventor: George J. Carson, 4323 S. Emerald Ave., Chicago, IL (US) 60609

( * ) Notice: Subject to any disclaimer, the term of this patent is extended or adjusted under 35 U.S.C. 154(b) by 0 days.

(21) Appl. No.: 11/296,827

(22) Filed: Dec. 7, 2005

(65) Prior Publication Data

US 2007/0125005 A1 Jun. 7, 2007

(51) Int. Cl.
*E04D 13/00* (2006.01)

(52) U.S. Cl. ..... 52/11

(58) Field of Classification Search ..... 52/11, 52/12, 16; 294/19.1; 210/162, 159
See application file for complete search history.

(56) References Cited

U.S. PATENT DOCUMENTS 3,740,787 A * 6/1973 Bowermaster ..... 15/105
3,977,135 A * 8/1976 Hunley, Jr. ..... 52/12
4,407,097 A * 10/1983 Allen ..... 52/11
4,852,308 A * 8/1989 Papenbrock et al. ..... 52/12
6,233,876 B1 5/2001 Obidniak
6,263,618 B1 7/2001 Jones
6,269,592 B1 8/2001 Rutter
6,493,994 B1 12/2002 Lucas
6,925,676 B2 8/2005 Heavner et al.
6,926,210 B2 8/2005 Baxter
6,964,135 B1 * 11/2005 Slodov ..... 52/11

* cited by examiner

*Primary Examiner*—Lanna Mai
*Assistant Examiner*—Adriana Figueroa
(74) *Attorney, Agent, or Firm*—Patula & Associates, P.C.

(57) ABSTRACT

A rain gutter cleaning system of the invention comprises a generally planar panel, or two generally planar panels, movably secured to the bottom of the gutter. The rain gutter cleaning system includes a hinge securing one end of the generally planar panel to the gutter. One generally planar panel is normally disposed in a first position. In this first position, the generally planar panel is adjacent to, and generally parallel to, the gutter. The generally planar panel may be moved to a second position. In this second position, the generally planar panel is pivotally spaced apart from the gutter.

14 Claims, 7 Drawing Sheets

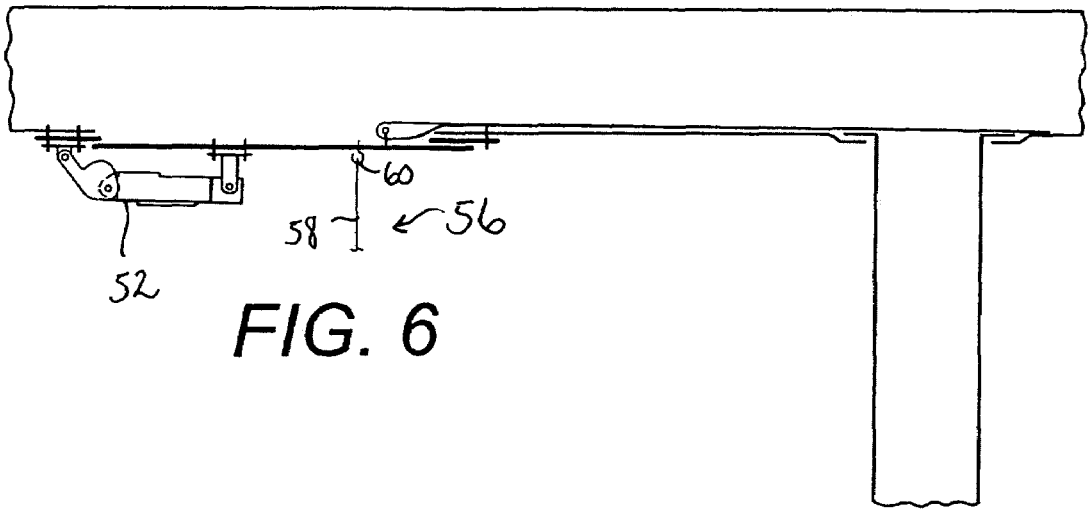
FIG. 6
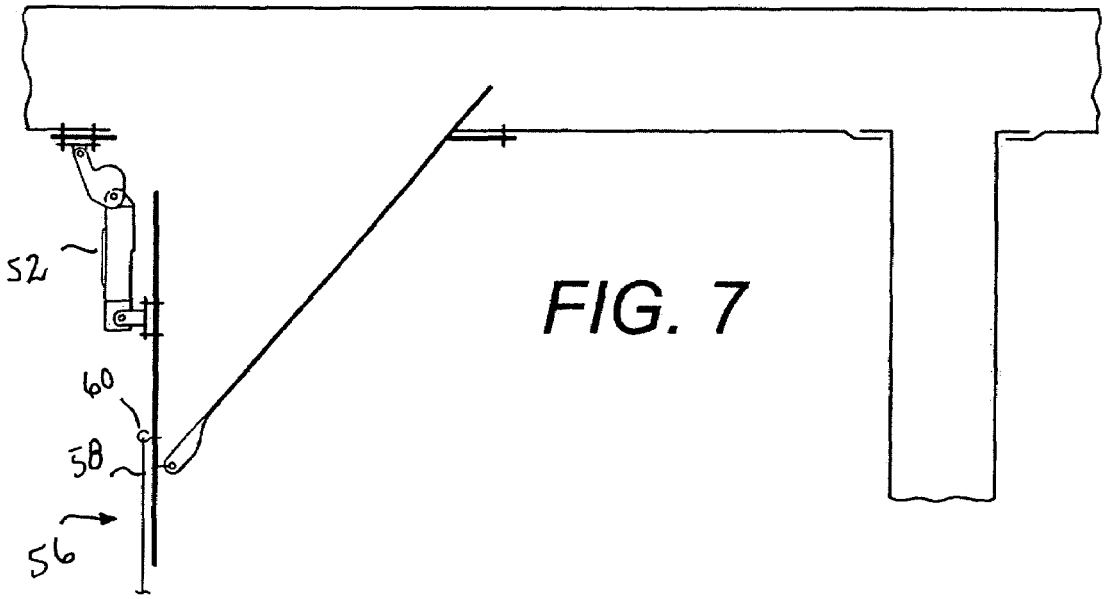
FIG. 7
FIG. 8
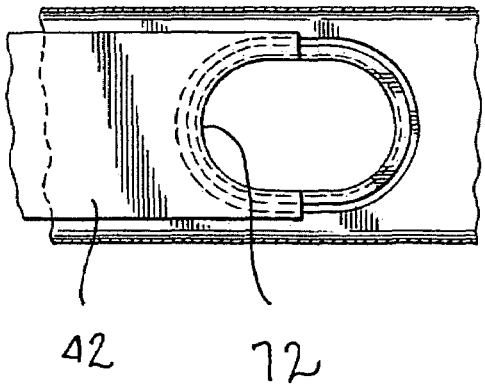
FIG. 9
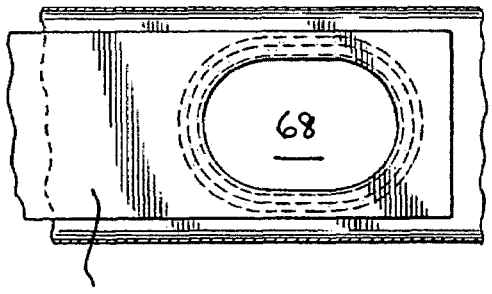

SYSTEM FOR DISLODGING AND REMOVING DEBRIS IN GUTTERS

TECHNICAL FIELD

The invention relates to a system for the dislodging and removal of leaves, twigs, and other debris from rain gutters and from the downspouts that are associated with downspouts.

BACKGROUND OF THE INVENTION

Rain gutters are typically positioned adjacent the roofs of commercial and residential buildings. Such rain gutters collect the rain water that falls upon peaked roofs. That rain water then moves into and through a downspout. A pipe extension at the bottom of the downspout directs that water away from the foundation of the building. This prevents water damage to the foundation of that building.

Conventional rain gutters are generally suitable for this purpose. However, due to their use in an outdoor environment, these rain gutters typically collect and eventually are clogged by leaves, twigs, and other environmental debris. As a result, the homeowner or business owner must frequently scale the roof of the building, and remove that debris from the gutters. The failure to do so will eventually result in clogging of the gutter, the downspout, or both. When such clogging occurs, the rain water on the roof cannot be transported through the gutter and downspout. That rain water instead accumulates within the gutter. Because the rain water in the gutter cannot be transported away from the building through the downspout and pipe extension, it eventually fills the gutter, and overflows along the side walls of the building. As a result, and instead the present invention is provided to solve the problems discussed above and other problems, and to provide advantages and aspects not provided by prior devices of this type. A full discussion of the features and advantages of the present invention is deferred to the following detailed description, which proceeds with reference to the accompanying drawings.

SUMMARY OF THE INVENTION

The invention is a rain gutter cleaning system. The gutter will typically have an opening at its bottom.

The rain gutter cleaning system of the invention comprises a generally planar panel movably secured to the bottom of said gutter. The rain gutter cleaning system further comprises a hinge securing one end of the generally planar panel to the gutter.

The generally planar panel is normally disposed in a first position. In this first position, the generally planar panel is adjacent to, and generally parallel to, the gutter.

The generally planar panel may be moved to second position. In this second position, the generally planar panel is pivotally spaced apart from the gutter.

In one embodiment of the invention, the hinge is spring-loaded.

In another embodiment of the invention, the generally planar panel has a rectangular shape.

In yet another embodiment of the invention, the rain gutter cleaning system comprises remote actuating means for remotely pulling upon the generally planar panel, and thereby pivotally separating the generally planar panel from the gutter.

A second embodiment of the invention is an attachment for a rain gutter. That attachment comprises a first generally planar panel, and a second generally planar panel. The second generally planar panel is pivotally secured to the first generally planar panel.

The attachment is movable from a first to a second position. In its first position, the first generally planar panel is generally parallel to the second generally planar panel. In the second position, the first generally planar panel is pivoted away from, and angularly disposed relative to, the second generally planar panel.

The attachment may further include a spring-loaded hinge, which pivotably secures the first generally rectangular panel to the gutter.

In another embodiment, the first generally planar panel is rectangular.

In yet another embodiment, the gutter has an opening, with a generally rectangular shape.

In a still further embodiment, the attachment may include remote actuating means for remotely pulling upon the first generally planar panel. In this way, the first generally planar panel is pivotably separated away from the second generally planar panel.

The attachment may include an orifice in the second generally planar panel. The orifice may be of any desired shape. However, the orifice preferably has an oval shape, or a circular shape.

The orifice may so have the shape of a portion of an oval, or the shape of a portion of a circle.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 6 is a side, sectional view of the attachment of FIG. 4;

FIG. 7 is a side, sectional view of the attachment of FIG. 5;

FIG. 8 is an overhead view of a partial orifice in the second generally planar panel;

FIG. 9 is an overhead view of a full orifice in the second generally planar panel.

DETAILED DESCRIPTION

Figure 1:
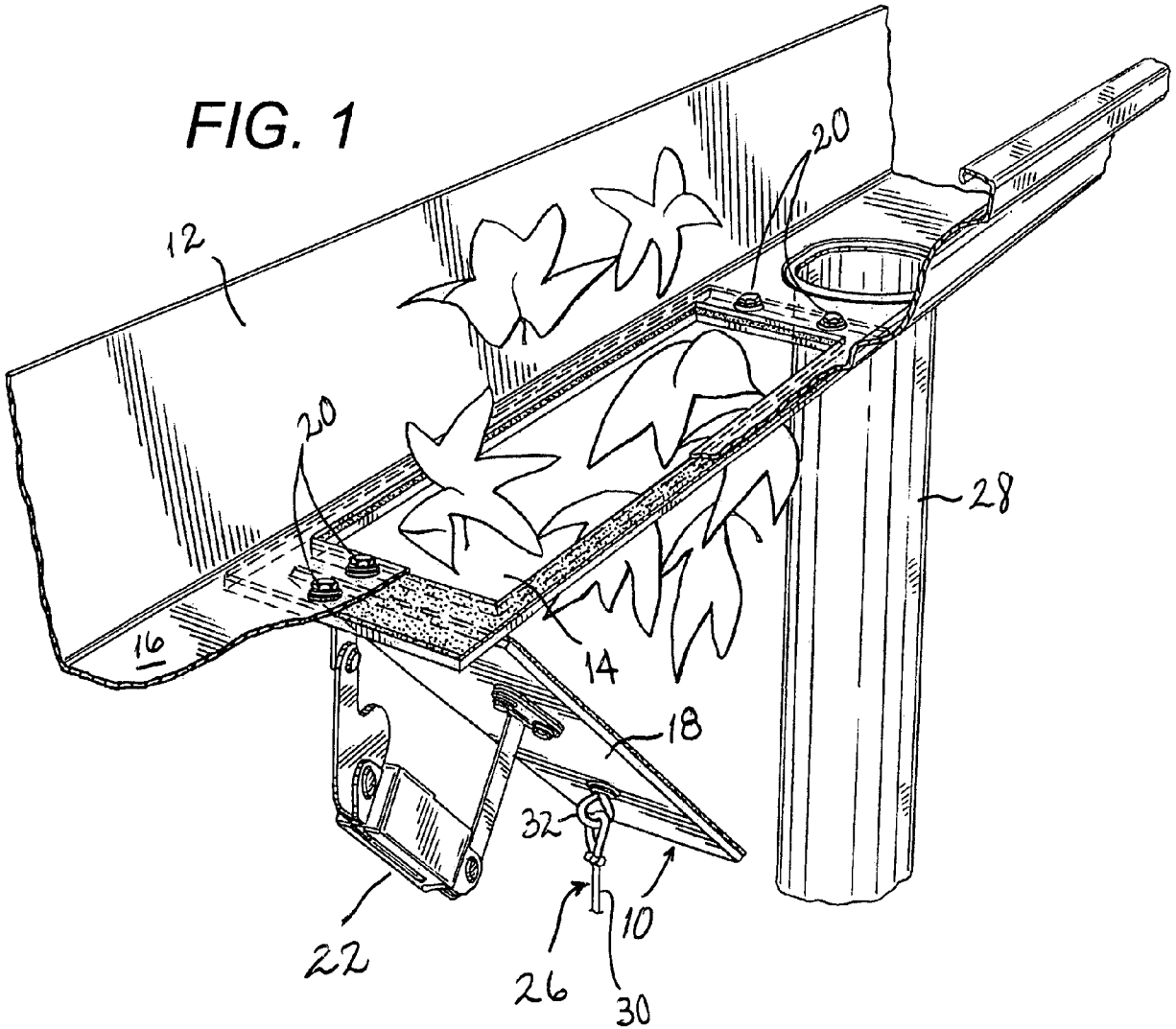
FIG. 1 is a perspective, partially sectioned view of a first embodiment of the invention, with the attachment in the closed position.

While this invention is susceptible of embodiments in many different forms, there is shown in the drawings and will herein be described in detail preferred embodiments of the invention. It should be understood that the present disclosure is to be considered as an example of the principles of the invention. The disclosure is not intended to limit the broad aspect of the invention to the illustrated embodiments.

Figure 2:
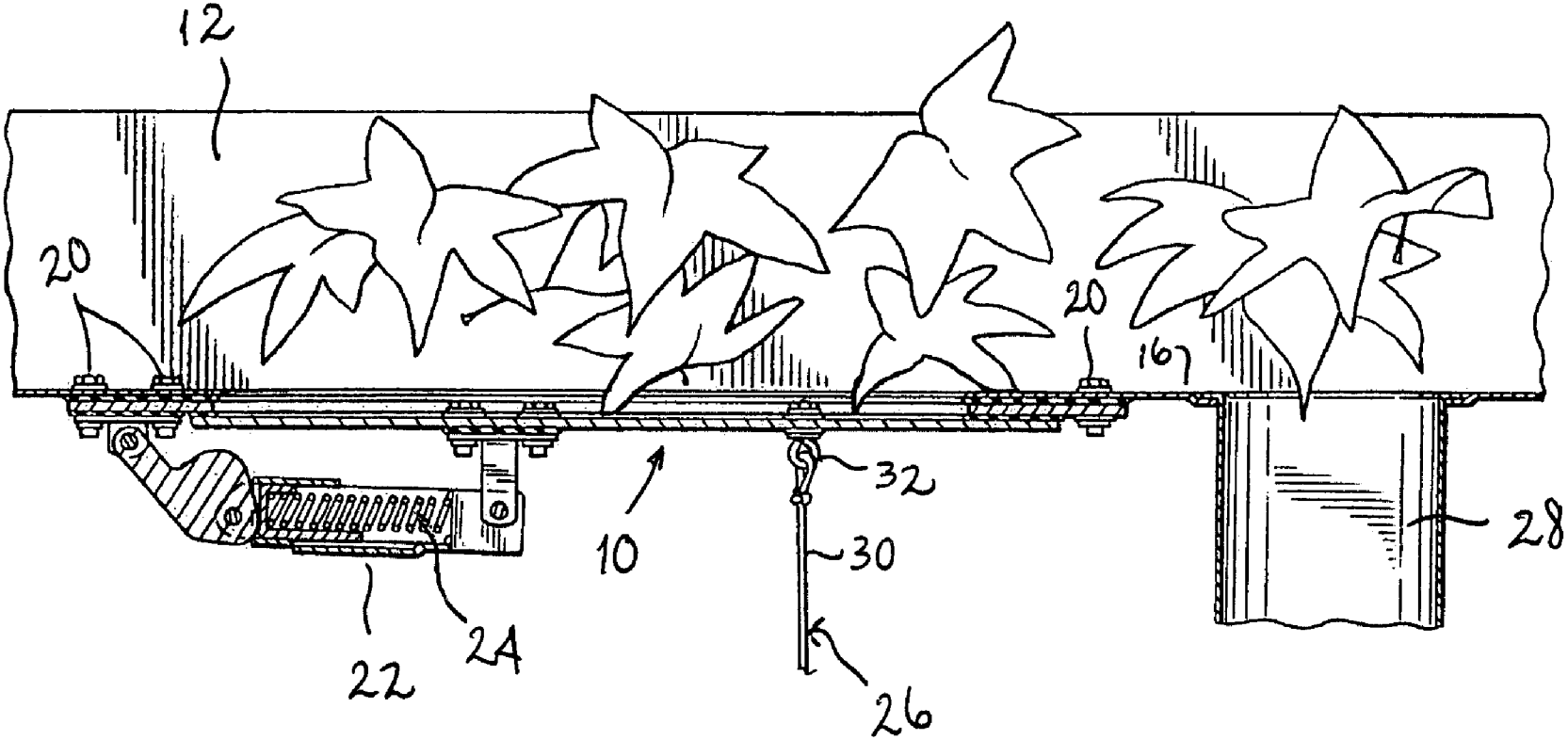
FIG. 2 is a side view of the embodiment of FIG. 1.
Figure 3:
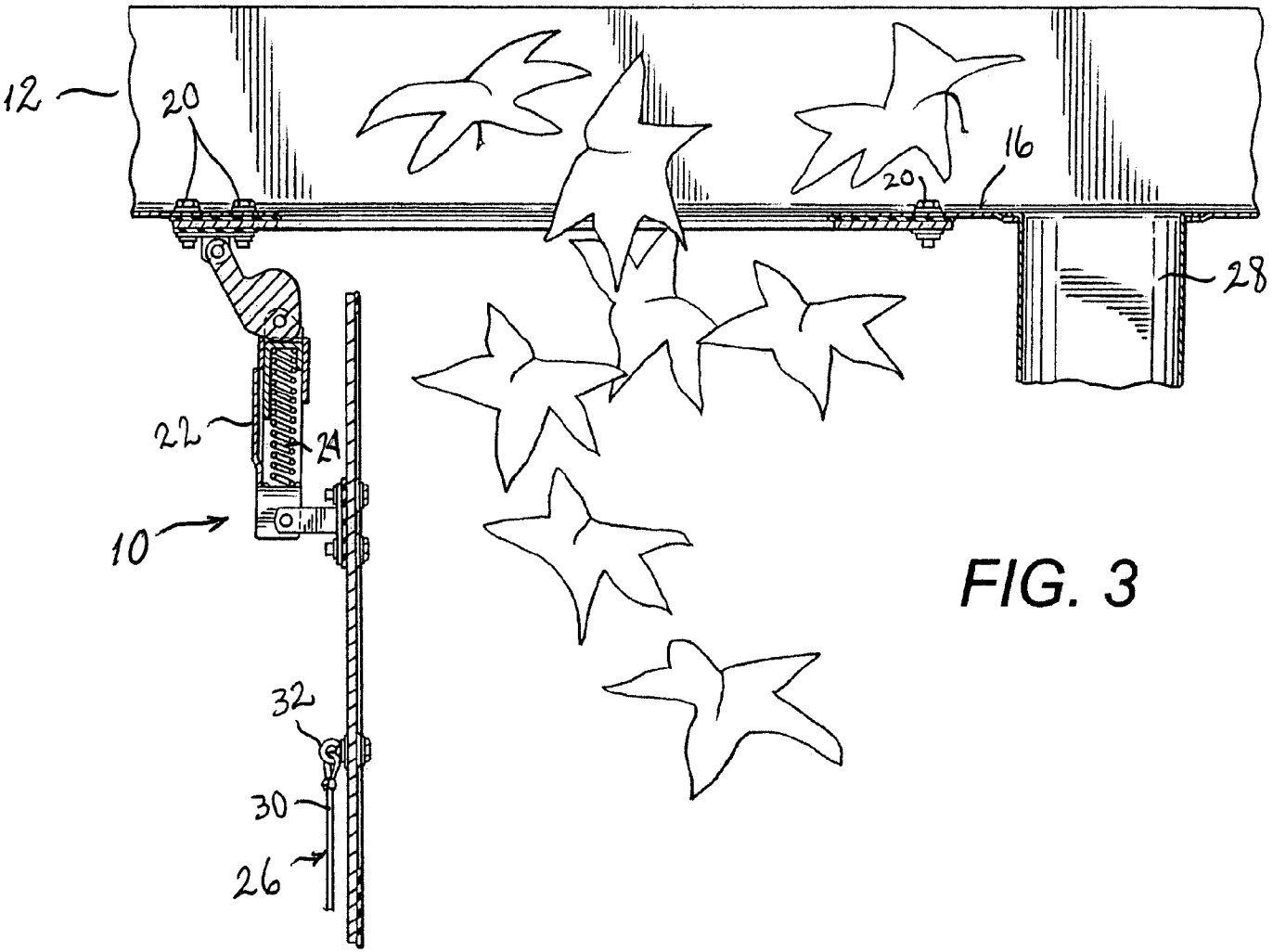
FIG. 3 is a side view of the embodiment of FIG. 2, but in the opened position.

Referring first to FIGS. 1-3, and particularly in FIG. 3, a first embodiment of the invention is a cleaning system 10 for a gutter 12. As may best be seen in FIG. 1, the gutter 12 will typically have an opening 14 at its bottom 16.

The rain gutter cleaning system 10 of the invention comprises a generally planar panel 18. This generally planar panel 18 may be made of any rigid material, but is preferably made of a sheet metal material.

This generally planar panel 18 is movably secured to the bottom 16 of the gutter 12. As may best be seen in FIG. 1, the generally planar panel 18 is attached by means of screws or bolts 20.

The rain gutter cleaning system 10 further comprises a hinge 22 securing one end of the generally planar panel 18 to the gutter 12. Preferably, as may be seen in FIGS. 2 and 3, the hinge 22 includes a spring 24. Normally, this spring 24 retains the generally planar panel 18 in the closed position, as shown in FIG. 2. When the generally planar panel 18 is moved away from the bottom 16 of the gutter 12, by the pulling upon the remote actuating means 26 by the user, as shown in FIGS. 1 and 3, the spring 24 in the hinge 22 is tensioned.

When the remote actuating means 26 is released by the user, the tensioned spring 24 causes the hinge 22 to return the generally planar panel 18 to the closed position of FIG. 2.

In the present embodiment, the remote actuating means 26 comprises a string or wire 30 secured to an eyelet 32. However, it will be understood that the remote actuating means can be any suitable means, including mechanical actuating means, electronic actuating means, or electrical actuating means.

In summary, the gutter cleaning system 10 of the invention permits the user to clean a gutter 12 from a remote location. Particularly, a generally planar panel 18 is moved from a closed position to an opened position, to empty leaves 34 and other debris that are clogging a gutter 12.

As noted above, the generally planar panel 18 is normally disposed in the first position of FIG. 2. In this first position, the generally planar panel 18 permits water entering the gutter 12 to move out of the gutter 12 via the downspout. When in this first position, the generally planar panel 18 is adjacent to, and generally parallel to, the bottom 16 of the gutter 12. The generally planar panel 18 may be of any suitable shape. Preferably, however, as may be seen in FIG. 1, this generally planar panel 18 has a rectangular shape.

As explained above, when the gutter 12 is clogged with leaves 34 or other debris, the generally planar panel 18 may be moved to the second position, as shown in FIGS. 1 and 3. In this second position, the generally planar panel 18 is pivotally spaced apart from the gutter 12. In this second position, the generally planar panel 18 moves away from the opening 14 at the bottom of the gutter 12, and permits the leaves to be removed from the gutter 12.

In yet another aspect of the invention, the rain gutter cleaning system comprises remote actuating means 26 for remotely pulling upon the generally planar panel, and thereby pivotally separating the generally planar panel 18 from the gutter 12. As noted above, in the embodiment of FIGS. 1-3, the remote actuating means 26 comprises a string or wire 30 secured to an eyelet 32. However, it will be understood that the remote actuating means can be any suitable means for effecting the separation of the generally planar panel 18 from the gutter 12. For example, as a substitute for the string or wire 30 and eyelet 32, one can utilize suitable alternative mechanical actuating means, electronic actuating means, or electrical actuating means.

Accordingly, as can be appreciated by a review of FIGS. 1-3, the gutter cleaning system 10 is shown in its normal position in FIG. 2. In this position, the generally planar panel 18 covers the opening 14, and permits water to travel from the gutter 12 to the top of the downspout 28. The water then enters the downspout 28, and falls through that downspout 28 to a position away from the house.

When the gutter 12 fills with leaves 34, as shown in FIGS. 1 and 3, the user grasps the string 30 or wire and pulls downwardly. This pulling action moves the generally planar panel 18 away from the opening 14, and as a result the leaves 34 fall through the opening 14 and out of the gutter 12.

When the leaves 34 have been emptied from the gutter 12, the user releases the string 30. The tensioned spring 24 in the hinge 22 causes the hinge 22 to move generally planar panel 18 back to its normal position, i.e., to the position of FIG. 2.

A second embodiment of the invention is the attachment for a rain gutter depicted in FIGS. 4-9. This second embodiment differs from the first embodiment, in that this second embodiment includes an additional structural element for removing leaves from gutters.

Particularly, when leaves enter gutters, and then remain in those gutters for extended periods of time, those leaves are subjected to rain, and to other natural, weather-related forces. As a result of those forces, those leaves may be compressed, and begin to decompose. Large numbers of these leaves can then stick to each other, and to the bottom and sides of a gutter. Oftentimes, the removal of such stuck-together leaves requires mechanical force, such as the force from high pressure air or water, or mechanical agitation from a broom or other tool. This second embodiment enables these clumps of leaves to be dislodged by a user on the ground.

Figure 4:
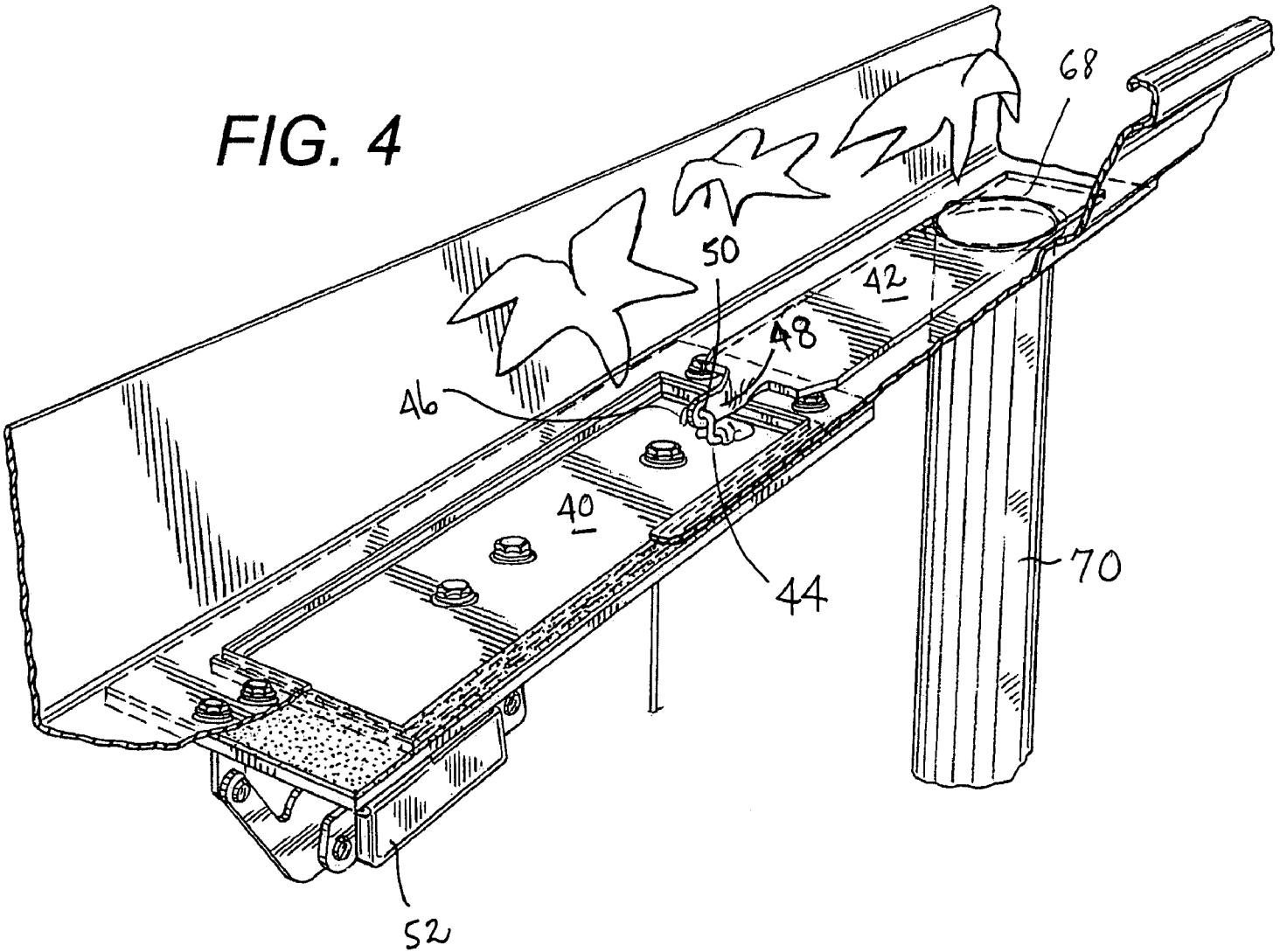
FIG. 4 is a perspective, partially sectioned view of a second embodiment of the invention, with the attachment in the closed position.
Figure 5:
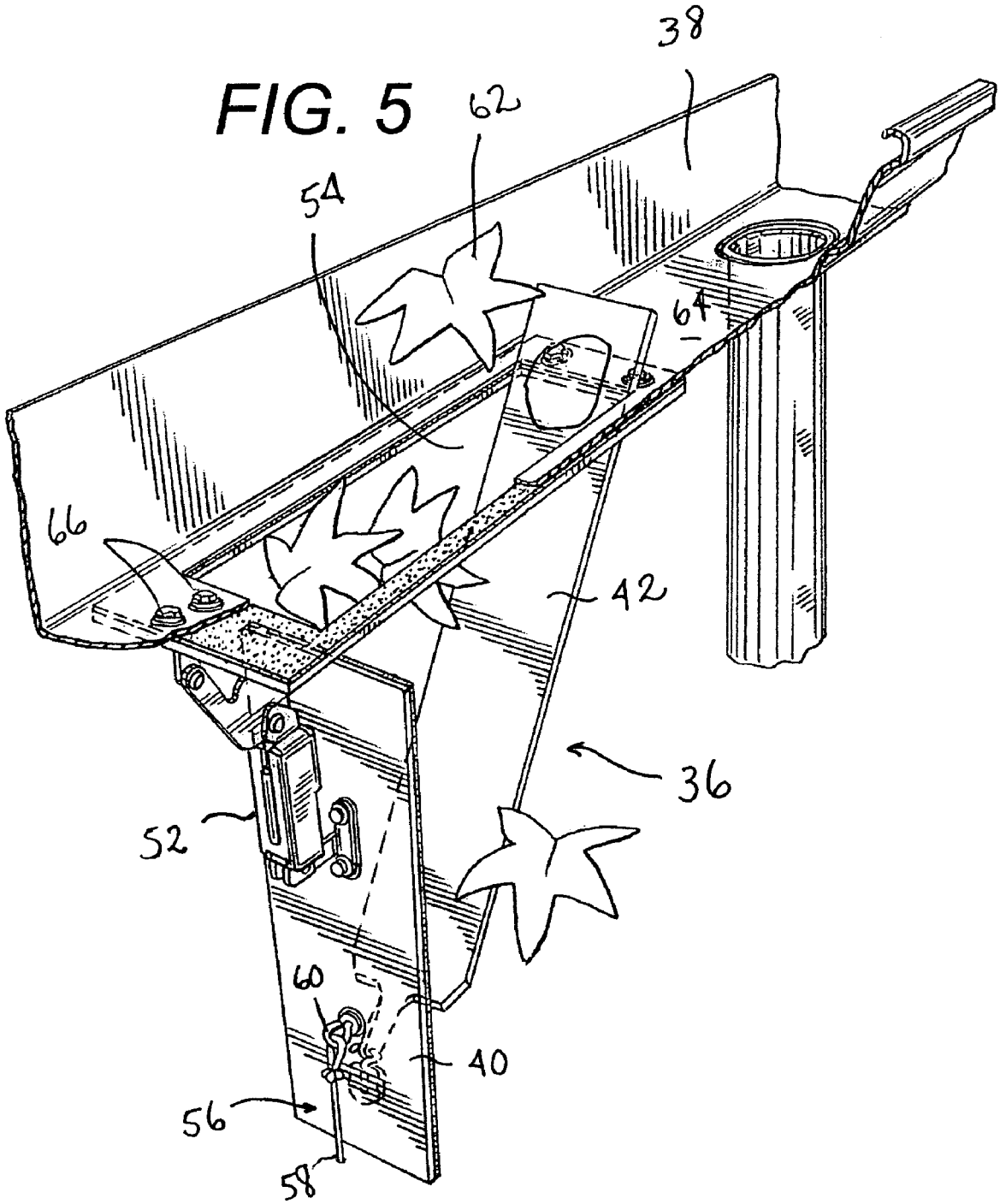
FIG. 5 is a perspective, partially sectioned view of the embodiment of FIG. 4, with the attachment in the opened position.

Specifically, as may be seen in FIGS. 4-9, and most particularly in FIG. 5, this second embodiment is comprised of an attachment 36 for a rain gutter 38. The attachment 36 includes both a first generally planar panel 40, and a second generally planar panel 42. The second generally planar panel 42 is pivotally secured to the first generally planar panel 40. As may be seen in FIG. 4, the first 40 and second generally planar panels 42 are pivoted relative to each other along a pivot point 44. This pivot point 44 comprises a hook 46 secured to the first generally planar panel, and a flange 48 secured to the second generally planar panel 42. The flange 48 includes an eyelet 50. An open end of the hook 46 enters the eyelet 50. The hook 46 pivots about, and within, the eyelet 50 of the flange 48.

The attachment 36 of FIGS. 4-9 is movable from a first to a second position. The first position is depicted in FIGS. 4 and 6, while the second position is depicted in FIGS. 5 and 7.

In its first position, as shown in FIGS. 4 and 6, the first generally planar panel 40 is generally parallel to the second generally planar panel 42.

In contrast, in the second position, as shown in FIGS. 5 and 7, the first generally planar panel 40 is pivoted away from, and angularly disposed relative to, the second generally planar panel 42

As with the first embodiment, the attachment 36 includes a spring-loaded hinge 52. This hinge 52 operates in a manner that is similar to the operation of hinge 22 of the first embodiment. First, the hinge 52 secures the first generally rectangular panel 40 in a parallel orientation relative to the gutter 38. Second, as will be explained below, the hinge 52 applies tension to the first generally rectangular panel 40, when the user pulls that panel 40 away from the gutter 38, to the positions shown in FIGS. 5 and 7; and forces the first generally rectangular panel 40 back to its original position, as shown in FIGS. 4 and 6, when the user releases his hold on the first generally rectangular panel 40

As may best be seen in FIGS. 4 and 5, the first generally planar panel 40 is preferably rectangular. However, the first generally planar panel 40 may be of any desired configuration or shape.

In yet another embodiment, the gutter 38 has an opening 54. As may best be seen in FIG. 5, this opening 54 has a generally rectangular shape.

In a still further embodiment, the attachment may include remote actuating means. Particularly, the rain gutter attachment 36 comprises remote actuating means 56 for remotely pulling upon the first generally planar panel 40. In this way, the first generally planar panel 40 is separated from the rain gutter 38, and the second generally planar panel 42 is pivoted relative to the first generally planar panel 40.

As in the embodiment of FIGS. 1-3, the remote actuating means 56 comprises a string or wire 58 secured to an eyelet 60. However, it will be understood that the remote actuating means 56 can be any suitable means for effecting the separation of the first generally planar panel 40 from the gutter 38. For example, as a substitute for the string or wire 58 and eyelet 60, one can utilize suitable alternative mechanical actuating means, electronic actuating means, or electrical actuating means. In this way, the first generally planar panel 40 is pivotably separated away from the second generally planar panel 42, and the first generally planar panel 40 may be separated away from the opening 54. As may be seen in FIG. 5, when the first generally planar panel 40 is separated from the opening 54, the leaves 62 fall through the opening, and are thereby removed from the gutter 38.

In this second embodiment, however, the second generally planar panel 42 helps to dislodge clumped leaves 62 and debris from the gutter 38. It does this when the second generally planar panel 42 is pivoted from its position as shown in FIG. 4, to its position as shown in FIG. 5. In moving between these positions, the second generally planar panel 42 lifts the clumped leaves and debris into the air, and away from the bottom 64 (FIG. 5) of the gutter 38. As may also be seen in the transition between FIGS. 4 and 5, the second generally planar panel 42 is moved from its horizontal position to an angle of about 45 degrees to the horizontal. At this 45 degree angle, gravity helps to cause the falling away of the loosened clumps of leaves and debris from the second generally planar panel 42. The clumps of leaves and debris fall through the orifice 54, and out of the gutter 38. As a result, the formerly clogged gutter 38 is now cleaned.

Screws or bolts 66 are provided for securing the attachment 36 to the gutter 38

In addition, as may best be seen in FIGS. 4, 8, and 9, the attachment 36 may include an orifice 68 in the second generally planar panel 42 The orifice 68 may be of any desired shape. However, the orifice 68 preferably has an oval shape, or a circular shape, so as to conform with the cross-sectional shape of the downspout 70.

The orifice 68 may have the shape of an oval or a circle. In FIGS. 4 and 9, the orifice 68 has a full oval shape.

Figure 10:
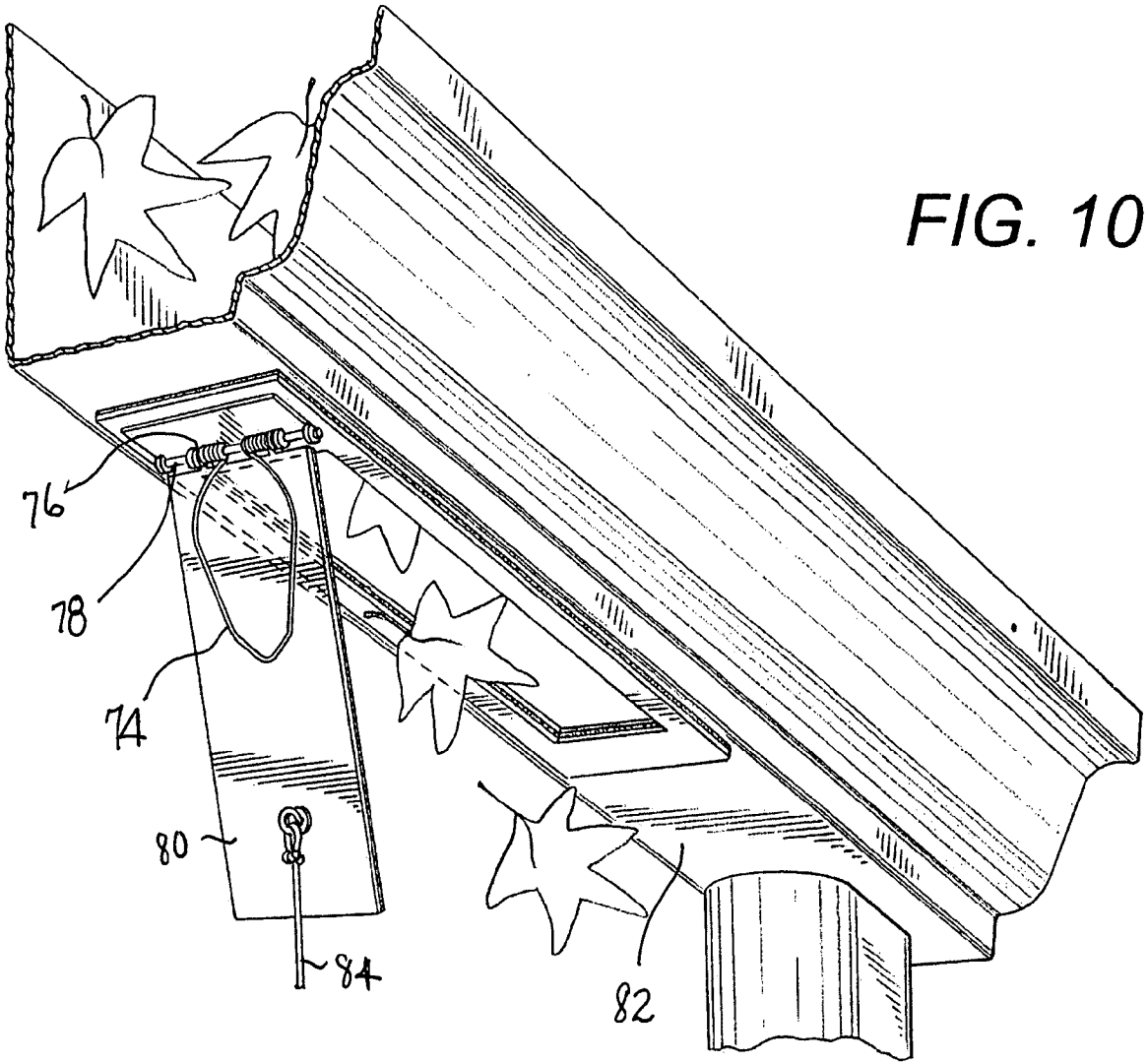
FIG. 10 is a perspective, partially sectioned view of a third embodiment of the invention, substantially similar to the embodiment shown in FIG. 5, but differing by the provision of a different hinge and spring combination.

Alternatively, as may be seen in FIG. 8, the orifice 72 may have the shape of a portion of an oval, or the shape of a portion of a circle A third embodiment is shown in FIG. 10. The embodiment of FIG. 10 is substantially similar to the embodiment shown in FIG. 5. However, the third embodiment of FIG. 10 provides a different hinge and spring combination. Particularly, as may be seen in this FIG. 10, the spring 74 is generally U-shaped, and can be made from a rigid metal wire. One end 76 of this spring 74 is coiled around a hinge point 78. The coiled end 76 of this spring 74 creates a tension on the planar panel 80 and about the hinge 78.

Particularly, the spring 74 normally acts upon the generally planar panel 80 secured to the bottom of the gutter 82. The generally planar panel 80 is movable from (a) a first position, wherein the generally planar panel 80 is adjacent and generally parallel to the gutter 82, to (b) a second position, wherein the generally planar panel 80 is pivotally spaced apart from the gutter 82. This second position is shown in FIG. 10.

This second position is attained when the user pulls upon string or wire 84. When the user releases the string or wire 84, the tension of the spring returns the generally planar panel 80 to its first position, adjacent and generally parallel to the gutter 82.

While the specific embodiments have been illustrated and described, numerous modifications come to mind without significantly departing from the spirit of the invention, and the scope of protection is only limited by the scope of the accompanying Claims.

What is claimed is:

1. An attachment in combination with a rain gutter to remove debris therefrom, comprising: (a) a first generally planar panel being pivotally attached to the rain gutter, wherein the rain gutter has an opening at its bottom, (b) a spring-loaded hinge securing the first generally rectangular panel to the bottom of the gutter, and (c) a second generally planar panel, the second generally planar panel being pivotally secured to the first generally planar panel;

the attachment being movable from a first position, wherein the first generally planar panel is generally parallel to the second generally planar panel and the bottom of the gutter, to a second position, wherein the first generally planar panel and the second generally planar panel are pivoted away from, and angularly disposed relative to, the opening in the rain gutter to remove debris through the opening.

2. The attachment of claim 1, wherein said first generally planar panel is rectangular.

3. The attachment of claim 1, wherein the opening has a generally rectangular shape.

4. The attachment of claim 1, further comprising actuating means for pulling upon the first generally planar panel, and thereby pivotally moving the first generally planar panel and the second generally planar panel away from the opening in the rain gutter.

5. The attachment of claim 1, further comprising an orifice in the second generally planar panel, said orifice being positioned around a downspout of the gutter when in the first position.

6. The attachment of claim 5, wherein said orifice has an oval shape.

7. The attachment of claim 5, wherein said orifice has a circular shape.

8. The attachment of claim 5, wherein said orifice has the shape of a portion of an oval.

9. The attachment of claim 5, wherein said orifice has the shape of a portion of a circle.

10. An apparatus in combination with a rain gutter allowing for the removal of debris from a gutter through an opening in a bottom of the gutter, the apparatus comprising:

a first panel for pivotal attachment to the bottom of the gutter, wherein the first panel, when attached the gutter, encloses the opening in a closed position, and swings down and away from the opening to an opened position;

a second panel pivotally attached to the first panel, wherein when the first panel is attached the gutter, the second panel lies on top of the bottom of the gutter, adjacent the opening, when in the closed position, and swings up away from the bottom of the gutter, and then slides down through the opening as the first panel moves from the closed position to the opened position;

wherein when the first is attached to the gutter, debris above the first panel and debris above the second panel in the closed position is removed from the gutter, through the opening, when the first panel is moved from the closed position to the opened position.

11. The apparatus of claim 10, wherein the first panel includes a hinge and spring for pivotal attachment to the bottom of the gutter.

12. The apparatus of claim 11, wherein the spring is generally U-shaped and has a coiled end engaging the hinge.

13. The apparatus of claim 10, further comprising a rope-like device attached to the first panel, allowing the first panel to be moved from the closed position to the opened position from a distance.

14. The apparatus of claim 10, wherein the first panel includes a seal for surrounding a perimeter of the opening.

* * * * *